US007655318B2

(12) United States Patent
Hall

(10) Patent No.: US 7,655,318 B2
(45) Date of Patent: Feb. 2, 2010

(54) TAXIDERMY HANGER SYSTEM AND METHOD

(76) Inventor: Stephen J. Hall, 4003 S. M-37 Hwy., Hastings, MI (US) 49058

( * ) Notice: Subject to any disclaimer, the term of this patent is extended or adjusted under 35 U.S.C. 154(b) by 30 days.

(21) Appl. No.: 11/966,172

(22) Filed: Dec. 28, 2007

(65) Prior Publication Data

US 2008/0164399 A1 Jul. 10, 2008

Related U.S. Application Data

(60) Provisional application No. 60/884,029, filed on Jan. 9, 2007.

(51) Int. Cl.
*A47G 29/00* (2006.01)

(52) U.S. Cl. ..... 428/542.4; 428/16; 428/99; 248/220.21; 248/221.11

(58) Field of Classification Search ..... 248/476, 248/477, 489, 495, 496, 498, 220.21, 221.11; 428/542.4, 99, 16
See application file for complete search history.

(56) References Cited

U.S. PATENT DOCUMENTS 2,099,332 A * 11/1937 Di Nuccio ..... 248/498
2,263,901 A * 11/1941 Olney ..... 248/496
2,483,114 A * 9/1949 Van Schoor et al. ..... 248/496
3,031,159 A * 4/1962 Waller ..... 52/544
3,871,609 A * 3/1975 Benjamin ..... 248/496
4,069,998 A * 1/1978 Rytting ..... 248/476
4,645,165 A * 2/1987 Raap ..... 248/476
4,717,626 A * 1/1988 Badger ..... 428/542.4
5,248,121 A * 9/1993 Harrington ..... 248/477
6,828,035 B1 * 12/2004 Goettl ..... 428/542.4
7,309,053 B2 * 12/2007 Lin ..... 248/476

* cited by examiner

*Primary Examiner*—Amy J Sterling
(74) *Attorney, Agent, or Firm*—Price, Heneveld, Cooper, DeWitt & Litton LLP

(57) ABSTRACT

A bracket is attached to the mounting board of a taxidermy work piece both to facilitate attachment and detachment of the work piece from an adjustable taxidermy stand by an individual, and also to later support the work piece on a building wall. The bracket includes co-planar attachment flanges with screw holes for attachment to a rear surface of the mounting board, a second flange spaced from the plane and that defines a shaped aperture for engaging a wall hook to hold the mounting board on a building wall for display, and a third flange extending downward from the second flange to form a recess to engage a top edge of the plate on the taxidermy stand. A related method is also illustrated, the method including temporarily supporting the work piece on the taxidermy stand until additional fasteners can be placed.

10 Claims, 3 Drawing Sheets

TAXIDERMY HANGER SYSTEM AND METHOD

CROSS REFERENCE TO RELATED APPLICATION

This application claims benefit under 35 U.S.C. § 119 of provisional application Ser. No. 60/884,029, filed Jan. 9, 2007, entitled "HELPING HAND HANGER SYSTEM," the contents of which are incorporated herein in their entirety by reference.

BACKGROUND

The present invention relates to a hanger system and method useful in the taxidermy industry to assist in the process of preparing animals and animal parts/heads/skins for display. The term "animals" is intended to include fish, reptiles, and other living things.

The art of taxidermy (i.e., preparing, stuffing, and mounting skins, heads, horns, parts of animals) takes considerable time, effort, and skill, and there are numerous steps in the process. It is not uncommon for a taxidermist to work on a work piece (e.g., animal skin/head/horns/parts and mounting board), and then leave the work piece for a while (e.g., to let it dry or set, or until the taxidermist is ready for a next step in the process). Adjustable holding stands help considerably, because they allow the work piece to be manipulated to a best position for doing work. However, taxidermists usually have a limited number of stands. As a result, the work piece is repeatedly put on the stand for work, and then taken off the stand and set aside while the taxidermist works on another work piece. The process of repeated attachment/detachment can be a problem since taxidermists often work alone (and/or a second person is not immediately available), and it is difficult to both hold the work piece and operate a screw driver to attach it to the adjustable stand.

By way of example, the shape of a deer's head begins with a foam support supported by a mounting board such as plywood. In one known method of attachment, the mounting board is attached to a holding stand by multiple screws that securely connect the mounting board to a plate on the adjustable holding stand. The animal's skin/head/horns are placed on, arranged, and fixed to the model support during various steps. The work piece must at all times be securely held so that it does not fall or become damaged while attaching or detaching the skin/head/horns to the adjustable stand. The difficulty in attachment/detachment is both because of bulkiness as well as weight (i.e., deer heads and antlers are often 20+ pounds, while larger game such as an African Kudu antelope can have a head weighing 75+ pounds). Further, since most taxidermists work alone, it is inconvenient to get assistance every time a work piece must be removed and a new one attached to the stand. I personally have experienced the difficulties of supporting a work piece while trying to secure it to an adjustable stand. It has been a problem for years, and I do not see anyone satisfactorily solving this problem.

There is a long felt need for a device and system that allows a taxidermist to detach and/or reattach a work piece (including an animal skin and/or head and/or foam-model and/or mounting board) to an adjustable stand without assistance, and specifically without the need to have a second person help in the attachment/detachment process. Further, a device and system is needed that is non-complex, that does not result in multiple additional parts and pieces, and that does not result in the use of expensive parts and pieces.

SUMMARY OF THE PRESENT INVENTION

In one aspect of the present invention, an apparatus is provided to facilitate securement of a taxidermy work piece to a taxidermy holding stand. The apparatus includes a mounting board including a front surface with an animal part thereon for display, and a bracket. The bracket has at least one first flange attached to a rear surface of the mounting board, a second flange spaced from the first flange and defining a shaped aperture for stably engaging a wall hook to hold the mounting board on a support structure for display, and a third flange forming a recess for receiving a top of a plate on the holding stand to temporarily stably support the mounting board on the plate until fasteners can be added to more securely attach the mounting board to the plate.

In another aspect of the present invention, a method comprises steps of providing a taxidermy stand with a plate for supporting a work piece, providing a mounting board including a front surface with an animal part thereon for display, and providing a bracket, where the bracket has at least one first flange configured for attachment to a rear surface of the mounting board, a second flange defining a shaped aperture for stably engaging a wall hook to hold the mounting board on a support structure for display, and a third flange forming a recess for receiving a top of the plate to temporarily stably support the mounting board on the plate of the holding stand until fasteners can be added to more securely attach the mounting board to the plate. The method includes attaching the bracket to the mounting board, and repeatedly performing a series of steps including temporarily attaching the mounting board to the plate using the bracket, fixedly attaching the mounting board to the plate using additional fasteners, doing work on the work piece, removing the additional fasteners, and then detaching the mounting board from the plate by disengaging the bracket from the plate. The method further includes mounting the mounting board on a wall using the bracket.

In yet another aspect of the present invention, a hanger bracket includes a pair of first flanges including coplanar rear surfaces defining a plane and including a hole in each first flange for receiving a first fastener to attach the first flanges to an item for display, a second flange spaced from the plane of the first flange and defining an elongated aperture with notches for engaging a wall-supported second fastener to stably hold the item for display in a first manner, and a third flange forming a recess with the plane for receiving a top of a support plate to temporarily stably support the mounting board on the plate in a second manner.

An object of the present invention is to facilitate safe and efficient methods of performing taxidermy work by an individual, including times when the individual desires to switch work pieces from an adjustable taxidermy stand without the assistance of others.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
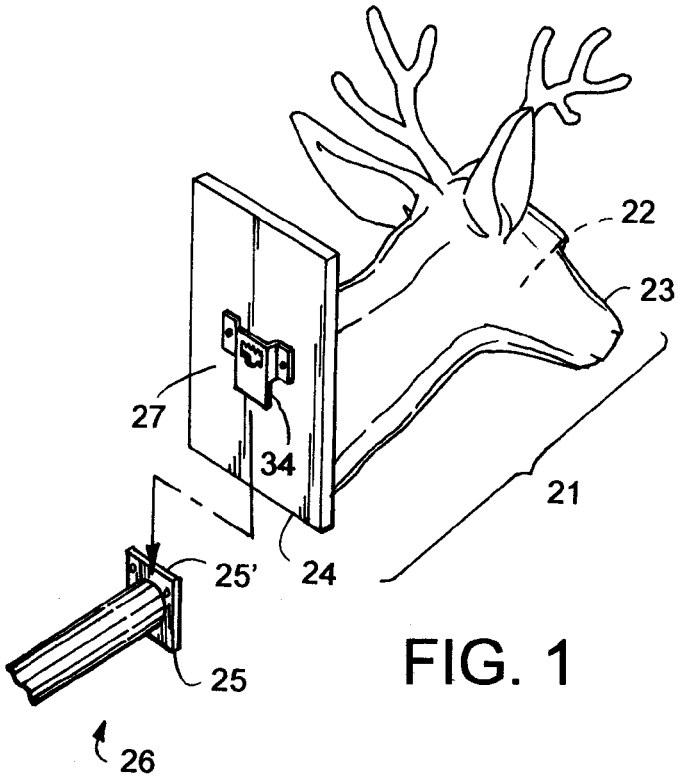
FIGS. 1-2 are perspective and side views of a partially-completed deer skin/head and foam model on a mounting board, and showing attachment of the mounting board to the plate of an adjustable stand.
Figure 2:
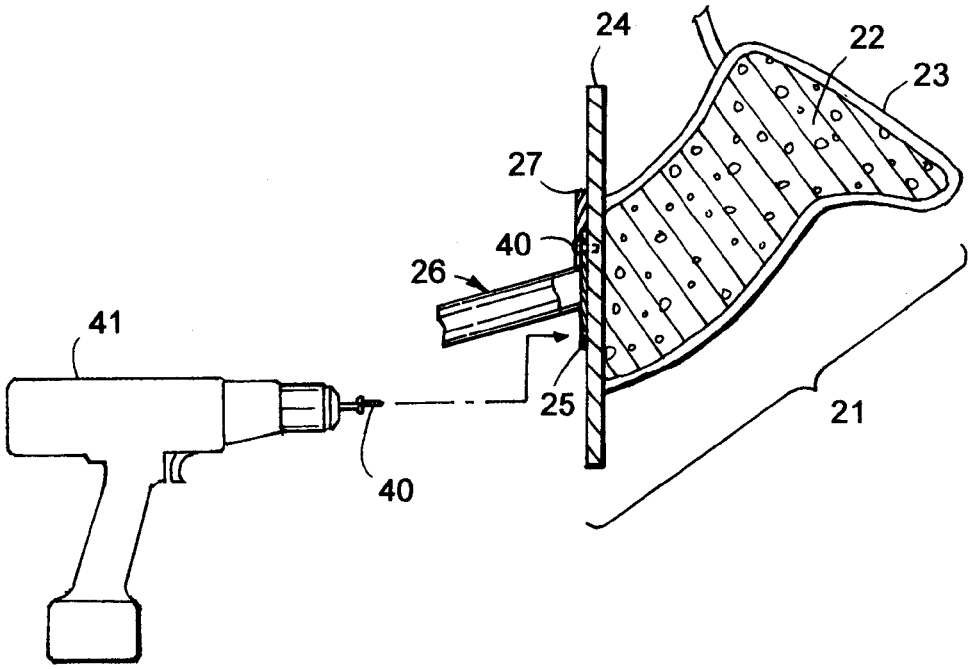
Figure 3:
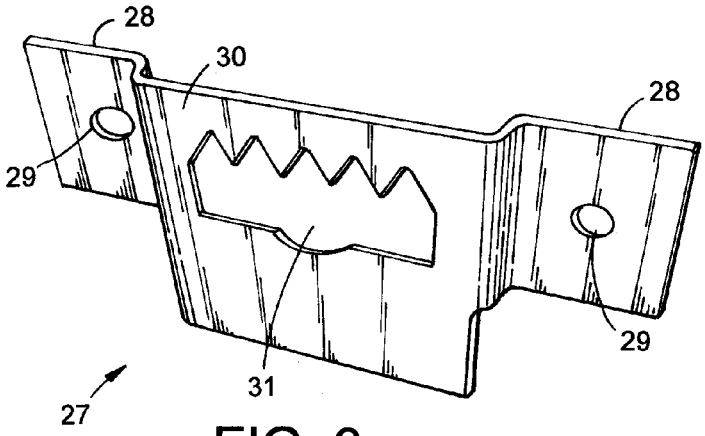
FIGS. 3-6 are perspective, top, front, and side views of the bracket allowing novel attachment of the mounting board to the plate.
Figure 4:
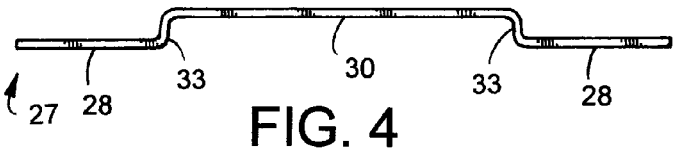
Figure 5:
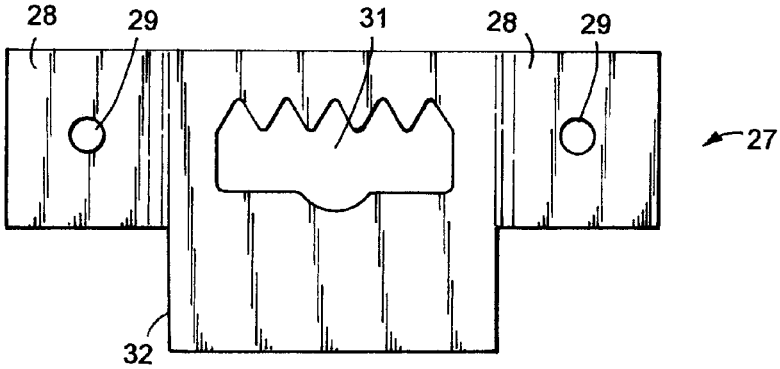
Figure 6:
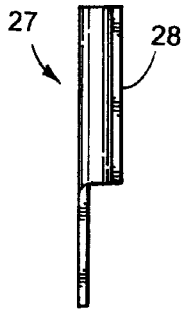
Figure 7:
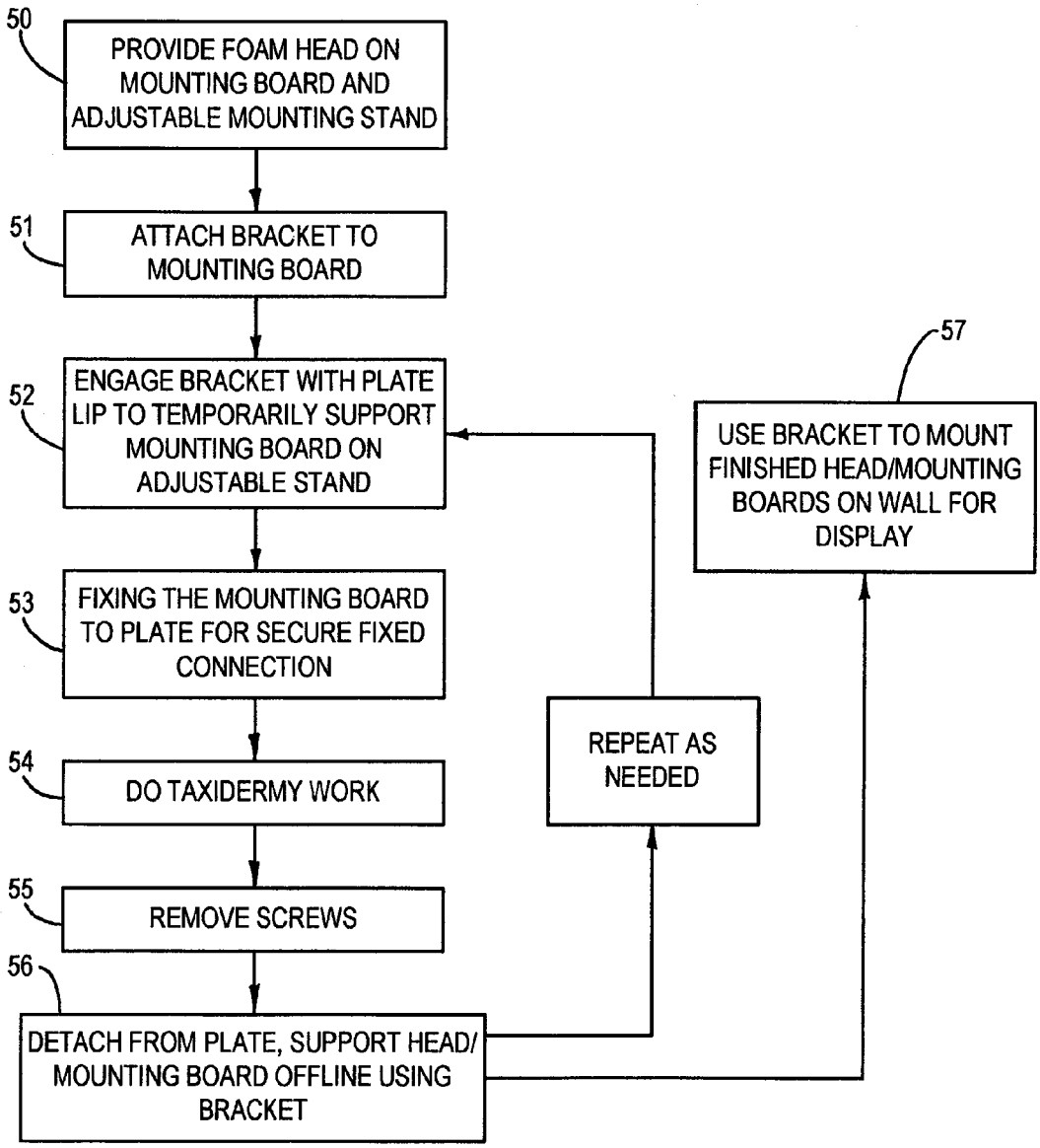
FIG. 7 is a flow chart showing the process of using the bracket of FIG. 3.

An apparatus and method (FIGS. 1-2) are designed to facilitate securement of a taxidermy work piece 21 to a plate 25 of an adjustable taxidermy holding stand 26, where its mounting board 24 (e.g., plywood) includes a front surface with foam shaped support 22 and animal part 23 optimally positioned thereon for display. The work piece 21, as the term is used herein, includes a foam shaped support 22 and/or an animal skin/head/horns/or/body-part 23 and/or a mounting board 24. The apparatus comprises a bracket 27 (FIGS. 3-6) and includes co-planar attachment flanges 28 with holes 29 for screw-attachment to a rear surface of the mounting board 24 and a second flange 30 spaced from the plane of the first flanges 28 by perpendicular sections 33 and defining a shaped aperture 31 for engaging a wall hook (such as a nail or stud or fixed wall-supported hanger) to hold the mounting board 24 on a building wall for display, and a third flange 32 extends downwardly from the second flange 30 and/or from the sections 33 to form a multi-sided recess 34 (FIG. 1) with the first flanges 28 and the sections 33 shaped to receive a top edge of the plate 25.

The bracket 27 is structural, and is designed to hold substantial weight as necessary for a weight of the contemplated work piece 21, until additional fasteners (screws 40, FIG. 2) can be added to secure the plate 25 to the board 24 (such as by screwdriver 41). The illustrated recess 34 is two-sided, as defined by the flange 32 and by the mounting board 24), and a bottom of the sections 33, and is designed to engage a top edge section 35 of the plate 25 (see FIG. 2) in a secure tongue-and-groove relationship. By this arrangement, it temporarily stably supports the mounting board 24 (and components 22-23) on the plate 25 of the adjustable stand 26 until additional fasteners (e.g., screws 40) can be added (through holes in the plate 25 into the board 24) to more securely attach the mounting board 24 to the plate 25. Notably, it is contemplated that the bracket 27 and/or the plate 25 can be modified to further provide security of their temporary assembly (i.e., prior to addition of the additional fasteners). For example, the plate 25 can include an upwardly-facing centered notch in area 25' with a width sufficient to receive the support sections 33 during assembly, . . . or alternatively the plate 25 can include an upwardly-facing centered tooth with a width shaped to nestingly fit between the support sections 33 under the flange 30 during assembly. Also, the engagement of the plate 25 into the recess 34 can be made frictional to prevent lateral slippage, such as by incorporating frictional material or by designing a slight friction fit into the assembly.

A related method comprises steps of providing an adjustable taxidermy stand 26 with a plate 25 for supporting the work piece (step 50), and providing the work piece 21 in the form of a mounting board 24 including a front surface with an animal part (foam support 22 and animal skin/head/horn/body-part 23) thereon for display, and including a rear surface, and providing a bracket 27 (also step 50). As noted above, the bracket 27 has the at least one first flange 28 configured for attachment to the rear surface, a second flange 30 defining a shaped aperture for engaging a wall hook to hold the mounting board on a wall for display, and a third flange 32 forming a recess 34 for receiving a top 35 of the plate 25 to temporarily support the mounting board 24 on the plate 25 of the stand 26 until fasteners (e.g., screws) can be added to more securely attach the mounting board 24 to the plate 25. The method includes attaching the bracket 27 to the mounting board 24 (step 51), and repeatedly temporarily attaching the mounting board 24 to the plate 25 using the bracket 27 (step 52), and then fixedly attaching the mounting board 24 to the plate 25 using additional fasteners (step 53), then doing work on the work piece 21 (step 54), then removing the additional fasteners (step 55), and then detaching the mounting board 24 including the bracket 27 from the plate 25 and storing it off-line (step 56). The method further includes, when finished with the taxidermy work, mounting the mounting board 24 on a building wall using the bracket 27 (step 57).

Notably, the illustrated bracket 27 is made of sheet steel or other strong material of sufficient strength, stiffness and size to support the particular work piece 21, such as a work piece weighing 20 to 75 pounds, so that the work piece 21 is safely supported on an adjustable stand until the additional fasteners are put in place. For example, the bracket may be 0.060 inch thick steel, with a total height of 1-⅞ inches, a total width of 4 inches, a flange 30 height of ⅞ inch, a flange 30 width of 1-⅛ inches, and a section 33 height of ¼ inch. The bracket 27 is also made to be sufficiently solid to hangingly support the work piece 21 on a building wall or support structure, allowing safe display of the work piece. As noted above, it is contemplated that the bracket 27 and/or the plate 25 can be modified to further provide security of their temporary assembly (i.e., prior to addition of the additional fasteners). For example, the plate 25 can include an upwardly-facing notch with a width sufficient to receive the support sections 33 during assembly, . . . or alternatively the plate 25 can include an upwardly-facing centered tooth with a width shaped to nestingly fit between the support sections 33 under the flange 30 during assembly . . . or alternatively can be designed to include a friction-fit condition.

It is also contemplated that a semi-automatic self-securing latch or securement on the bracket 27 (or on the plate 25) could provide the fixed securement of the work piece 21 to the plate 25. For example, a clamp could be provided on the bracket to replace the screws, the clamp being removable after the taxidermy process is complete and prior to placing/securing the work piece to a building wall for display. Accordingly, it is contemplated that a scope of the present apparatus is not limited to only the illustrated shape of the present bracket, and that the method is similarly not unnecessarily limited.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. An apparatus to facilitate taxidermy work, comprising:

a mounting board including a front surface with an animal part thereon for display; and a bracket having at least one first flange attached to a rear surface of the mounting board, a second flange spaced from the first flange and defining a shaped aperture for engaging a wall hook to hold the mounting board on a support structure for display, and a third flange forming a recess;

an adjustable taxidermy holding stand including a post and a plate at a top of the post, the plate including a top edge engaging the recess frictionally to prevent lateral slippage and to temporarily support the mounting board on the stand until fasteners can be added to more securely attach the mounting board to the plate.

2. The apparatus defined in claim 1, wherein the first flange defines a first plane and the second flange defines a second plane spaced from the first plane.

3. The apparatus defined in claim 2, wherein the shaped aperture is horizontally elongated.

4. The apparatus defined in claim 3, wherein the third flange extends downward from the second flange.

5. The apparatus defined in claim 1, wherein the third flange extends downward from the second flange and extends below the at least one first flange.

6. The apparatus defined in claim 1, wherein the second flange includes a plurality of downwardly facing notches.

7. The apparatus defined in claim 1, wherein the bracket includes sections of material that extend between the first and second flanges and are configured to abut a top of the plate when the bracket is engaged with the plate.

8. The apparatus defined in claim 1, wherein the bracket is made from steel with sufficient strength and stiffness to hold a weight of 20 or more pounds.

9. The apparatus defined in claim 1, wherein the third flange extends below the first and second flanges.

10. The apparatus defined in claim 1, wherein the third flange is coplanar with the second flange.

* * * * *